US010464090B2

(12) United States Patent
Ophardt et al.

(10) Patent No.: US 10,464,090 B2
(45) Date of Patent: Nov. 5, 2019

(54) AIR ASSISTED SEVERANCE OF FLUID STREAM

(71) Applicant: OP-Hygiene IP GmbH, Niederbipp (CH)

(72) Inventors: Heiner Ophardt, Arisdorf (CH); Andrew Jones, St. Anns (CA); Zhenchun Shi, Hamilton (CA)

(73) Assignee: OP-Hygiene iP GmbH, Niederbipp (CH)

( * ) Notice: Subject to any disclaimer, the term of this patent is extended or adjusted under 35 U.S.C. 154(b) by 0 days.

(21) Appl. No.: 16/177,628

(22) Filed: Nov. 1, 2018

(65) Prior Publication Data

US 2019/0070622 A1 Mar. 7, 2019

Related U.S. Application Data

(63) Continuation of application No. 15/248,847, filed on Aug. 26, 2016, now Pat. No. 10,150,128.

(30) Foreign Application Priority Data

Sep. 1, 2015 (CA) ..... 2902751

(51) Int. Cl.

| | |
|---|---|
| ***B05B 11/00*** | (2006.01) |
| ***F04B 53/14*** | (2006.01) |
| ***F04B 53/10*** | (2006.01) |
| ***F04B 23/02*** | (2006.01) |
| ***F04B 19/22*** | (2006.01) |
| ***B05B 15/55*** | (2018.01) |
| ***A47K 5/14*** | (2006.01) |
| ***A47K 5/12*** | (2006.01) |
| ***F04B 19/06*** | (2006.01) |

(52) U.S. Cl.

CPC ..... *B05B 11/3087* (2013.01); *A47K 5/1211* (2013.01); *A47K 5/14* (2013.01); *B05B 11/3001* (2013.01); *B05B 15/55* (2018.02); *F04B 19/06* (2013.01); *F04B 19/22* (2013.01); *F04B 23/025* (2013.01); *F04B 53/10* (2013.01); *F04B 53/14* (2013.01)

(58) Field of Classification Search

CPC .... A47K 5/14; A47K 5/1211; B05B 11/3087; B05B 11/3001; B05B 15/55; F04B 19/06; F04B 19/22; F04B 23/025; F04B 53/10; F04B 53/14

USPC ..... 222/190, 383.1, 321.7–321.9

See application file for complete search history.

(56) References Cited

U.S. PATENT DOCUMENTS

| | | | |
|---|---|---|---|
| 5,165,577 | A | 11/1992 | Ophardt |
| 5,676,277 | A | 10/1997 | Ophardt |
| 6,601,736 | B2 | 8/2003 | Ophardt et al. |
| 7,267,251 | B2 | 9/2007 | Ophardt |
| 7,303,099 | B2 | 12/2007 | Ophardt |
| 8,365,965 | B2 | 2/2013 | Ophardt |

(Continued)

*Primary Examiner* — Paul R Durand
*Assistant Examiner* — Andrew P Bainbridge
(74) *Attorney, Agent, or Firm* — Thorpe North and Western, LLP

(57) ABSTRACT

A method and apparatus for dispensing flowable fluids by dispensing the flowable fluid through a passageway leading to a discharge outlet in one stroke of a piston pump and, in a second opposite stroke of the piston pump, discharging air into the passageway to displace the fluid from the passageway through the outlet.

20 Claims, 12 Drawing Sheets

(56) References Cited

U.S. PATENT DOCUMENTS

| | | | | |
|---|---|---|---|---|
| 8,413,855 | B2 * | 4/2013 | Ophardt | F04B 53/14 222/181.3 |
| 8,474,664 | B2 | 7/2013 | Ophardt et al. | |
| 8,733,588 | B2 | 5/2014 | Ophardt et al. | |
| 8,875,952 | B2 * | 11/2014 | Ciavarella | B05B 7/0025 222/145.5 |
| 8,893,932 | B2 * | 11/2014 | Ophardt | A47K 5/1207 222/321.9 |
| 8,919,611 | B2 | 12/2014 | Ophardt et al. | |
| 9,573,152 | B2 * | 2/2017 | Ophardt | B05B 11/3087 |
| 9,854,947 | B2 * | 1/2018 | McNulty | A47K 5/14 |
| 2011/0240680 | A1 | 10/2011 | Ophardt et al. | |
| 2012/0000931 | A1 | 1/2012 | Cabiri | |
| 2013/0112715 | A1 | 5/2013 | Ophardt | |
| 2013/0233441 | A1 | 9/2013 | Ciavarella | |

* cited by examiner

AIR ASSISTED SEVERANCE OF FLUID STREAM

RELATED APPLICATION

This application is a continuation of co-pending U.S. patent application Ser. No. 15/248,847 filed Aug. 26, 2016 and claims the benefit of 35 U.S.C. 120.

SCOPE OF THE INVENTION

This invention relates to methods and pumps useful for severance of a stream of foamable material by the injection of air into a discharge passageway and, more particularly, to a piston pump in which the assisted severance of the stream of flowable material is by injection of the air in a stroke of the piston different from the stroke in which the flowable material is discharged.

BACKGROUND OF THE INVENTION

Many pump assemblies are known for dispensing flowable material such as hand soap. Previously known pump assemblies suffer the disadvantage that in operation of the pump, the flowable material being dispensed fills a discharge outlet and, after dispensing, may extend from the discharge outlet. This difficulty is particularly acute when the flowable material may have relatively high viscosity such as arises with hand creams and lotions and viscous toothpastes, skin creams and hand cleaners which may or may not include particulate matter.

The present inventors have appreciated that previously known dispensers do not provide advantageous arrangements for expelling from an outward most position of a discharge passageway leading to a discharge outlet substantially all of the flowable material.

The present inventors have appreciated that previously known piston pumps which attempt to inject air into a passageway to sever a fluid stream suffer from the disadvantages that the pumps are not operative when the piston of the pump is not be moved through a full stroke since the air is be injected merely if the piston is moved completely to either a retracted position or withdrawn positions. The present inventors have thus appreciated that previously known pumps suffer the disadvantage that they do not provide for adequate air severance insofar as a pump may be cycled through a partial stroke, that is, without actually moving completely to a withdrawn position and/or a retracted position.

SUMMARY OF THE INVENTION

To at least partially overcome these disadvantages of previously known devices, the present invention provides a method and apparatus for dispensing flowable fluids by dispensing the flowable fluid through a passageway leading to a discharge outlet in one stroke of a piston pump and, in a second opposite stroke of the piston pump, discharging air into the passageway to displace the fluid from the passageway through the outlet.

The invention provides for a piston pump with a piston-forming element coaxially movable relative a piston chamber-forming member between a withdrawn position and a retracted position in a cycle of operation comprising a withdrawal stroke and a retraction stroke. The piston pump provides both a liquid pump and an air pump. In a liquid discharge stroke of the liquid pump, the liquid pump discharges liquid through a passageway to a discharge outlet and in an opposite, charge stroke of the liquid pump, the liquid pump draws liquid from a reservoir. The air pump operates during the discharge stroke of the liquid pump to draw air in from the atmosphere and, in the charge stroke of the liquid pump, to discharge air into the passageway to displace outwardly through the outer end of the passageway the fluid within the passageway.

The liquid pump and the air pump are preferably provided in a piston pump formed between a piston chamber-forming member and a piston-forming element. The piston chamber-forming member defines a central chamber therein and the piston-forming element is coaxially slidably received in the chamber. The piston-forming element preferably comprises an elongate tubular stem with a central passageway extending from an inner end to an outer end. The piston-forming element is coaxially slidably received within the piston chamber-forming member between a withdrawn position and a retracted position in a cycle of operation comprising a withdrawal stroke and a retraction stroke to draw the liquid from the reservoir and discharge the liquid through the outer end of the passageway which extends outwardly through an outer end of the piston chamber-forming member. Preferably, two transfer ports are provided to extend inwardly through the stem into the passageway with the two ports being axially spaced from each other. The piston pump is adapted to discharge fluid through a first transfer port and the air pump is adapted to discharge fluid through the second transfer port. One or more valving arrangements may be provided to close one or more of the transfer ports to flow during portions of the cycle of operation.

Preferably, the liquid pump operate such that a discharge stroke of the liquid pump comprises the retraction stroke of the piston forming element when liquid is discharged from the first transfer port into the passageway and through the passageway to the outer end of the passageway and outwardly through the outer end of the passageway and, in a charge stroke of the liquid pump consisting of the withdrawal stroke of the piston forming element, liquid is drawn from the reservoir. In such an arrangement, the air pump during the retraction stroke of the piston forming element draws air in and, during the withdrawal stroke of the piston forming element, discharges air through the second transfer port into the passageway and through the passageway to the outer end of the passageway thereby displacing outwardly through the outer end of the passage fluid within the passageway outwardly from the second transfer port.

In one aspect, the present invention provides a piston pump comprising:

a piston chamber-forming member extending longitudinally about an axis from an inner end to an outer end;

the piston chamber-forming member defining a central chamber therein coaxially about the axis within an annular chamber wall;

the piston chamber-forming member having a liquid inlet at the inner end in communication with a liquid in a reservoir;

a piston-forming element coaxially slidably received within the chamber in the piston chamber-forming member;

the piston-forming element comprising an elongate tubular stem with a central passageway longitudinally therethrough, the passageway extending from an inner end to an outer end;

the piston-forming element coaxially slidable within the piston chamber-forming member between a withdrawn position and a retracted position in a cycle of operation comprising a withdrawal stroke and a retraction stroke to draw the liquid from the reservoir via the liquid inlet and discharge the liquid through the outer end of the passageway;

a first transfer port extending radially inwardly through the stem into the passageway, a second transfer port which extends radially inwardly through the stem into the passageway spaced axially on the stem from the first transfer port, a liquid pump formed between the piston chamber-forming member and the piston-forming element proximate the inner end of the piston chamber-forming member, the liquid pump operative in the cycle of operation in a charge stroke, consisting of one of the withdrawal stroke and the retraction stroke, to draw the liquid from the reservoir via the liquid inlet and, in a discharge stroke, consisting of one of the withdrawal stroke and the retraction stroke which is not the charge stroke, to discharge the liquid through the first transfer port into the passageway and through the passageway to the outer end of the passageway and outwardly through the outer end of the passageway;

an air pump formed between the piston chamber-forming member and the piston-forming element operative in the cycle of operation in the discharge stroke to draw air from the atmosphere and, in the charge stroke, to discharge air into the passageway through the second transfer port into the passageway and through the passageway to the outer end of the passageway thereby displacing outwardly through the outer end of the passageway the fluid within the passageway outwardly from the second transfer port.

In another aspect, the present invention provides a piston pump comprising a piston chamber-forming member and a piston-forming element coaxially reciprocally slidable in a cycle of operation including a retraction stroke and a withdrawal stroke, a liquid pump defined between the piston chamber-forming member and the piston-forming element to draw in liquid from a reservoir and to discharge the liquid from a discharge outlet during a first time interval in the cycle of operation, an air pump defined between the piston chamber-forming member and the piston-forming element to draw in atmospheric air and to discharge air from the discharge outlet during a second time interval in the cycle of operation. Preferably, the first time interval comprises the retraction stroke and the second time interval comprises the withdrawal stroke.

BRIEF DESCRIPTION OF THE DRAWINGS

Further aspects and advantages of the present invention will appear from the following description taken together with accompanying drawings in which.

DETAILED DESCRIPTION OF THE DRAWINGS

Figure 1:
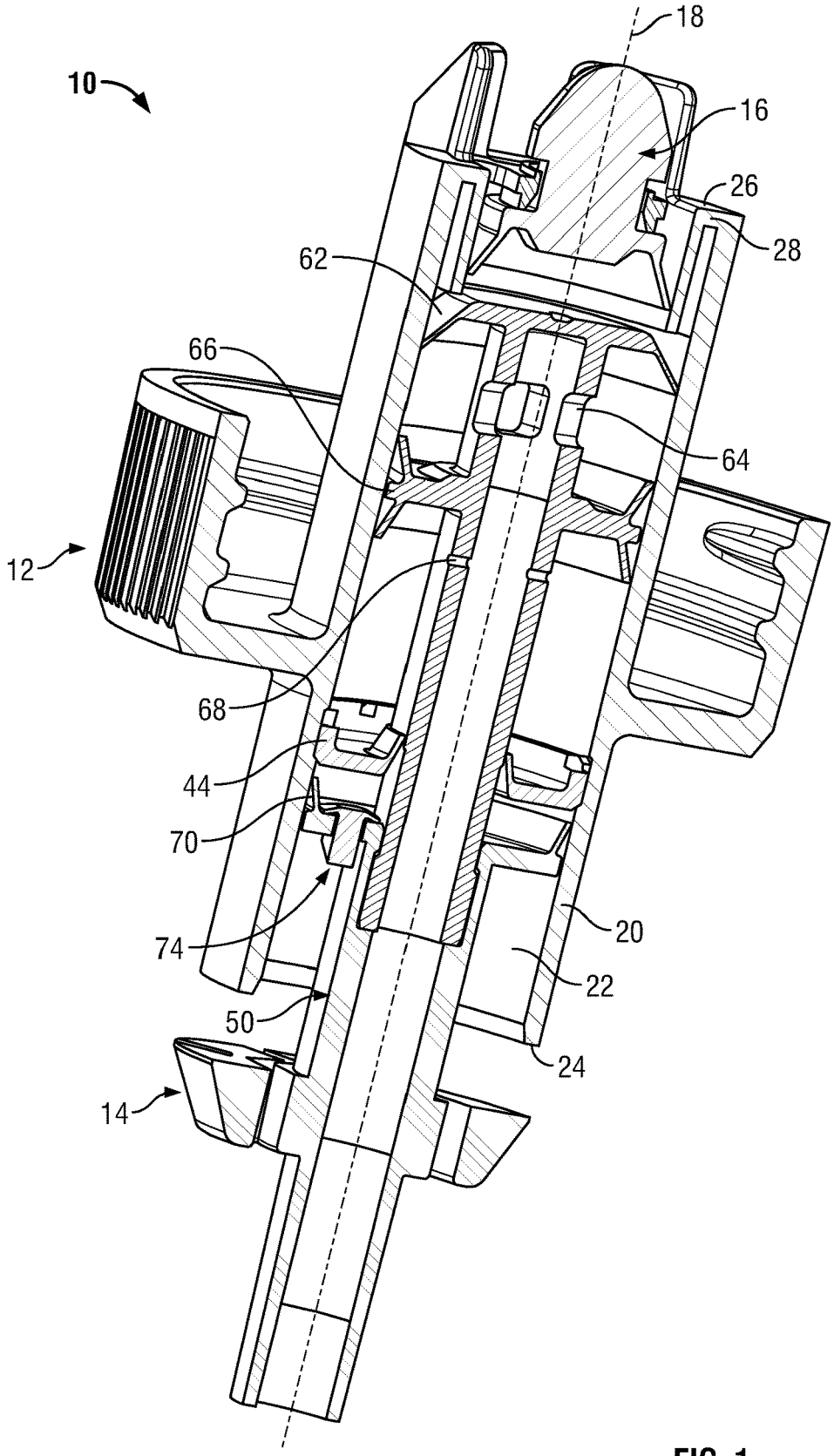
FIG. 1 is a pictorial cross-sectional front view of a piston pump in accordance with a first embodiment of the present invention with the piston in a retracted position.
Figure 2:
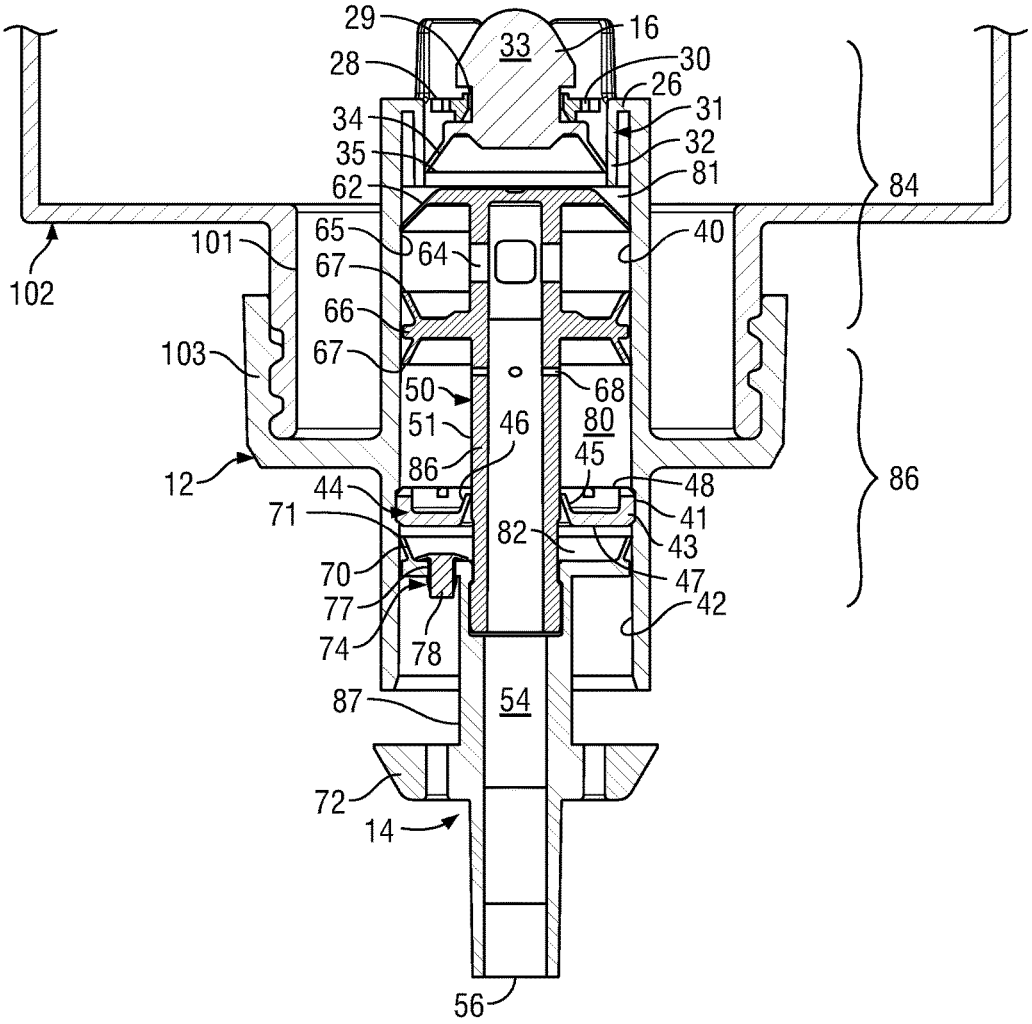
FIG. 2 is a cross-sectional front view of the pump of FIG. 1 in the retracted position.
Figure 3:
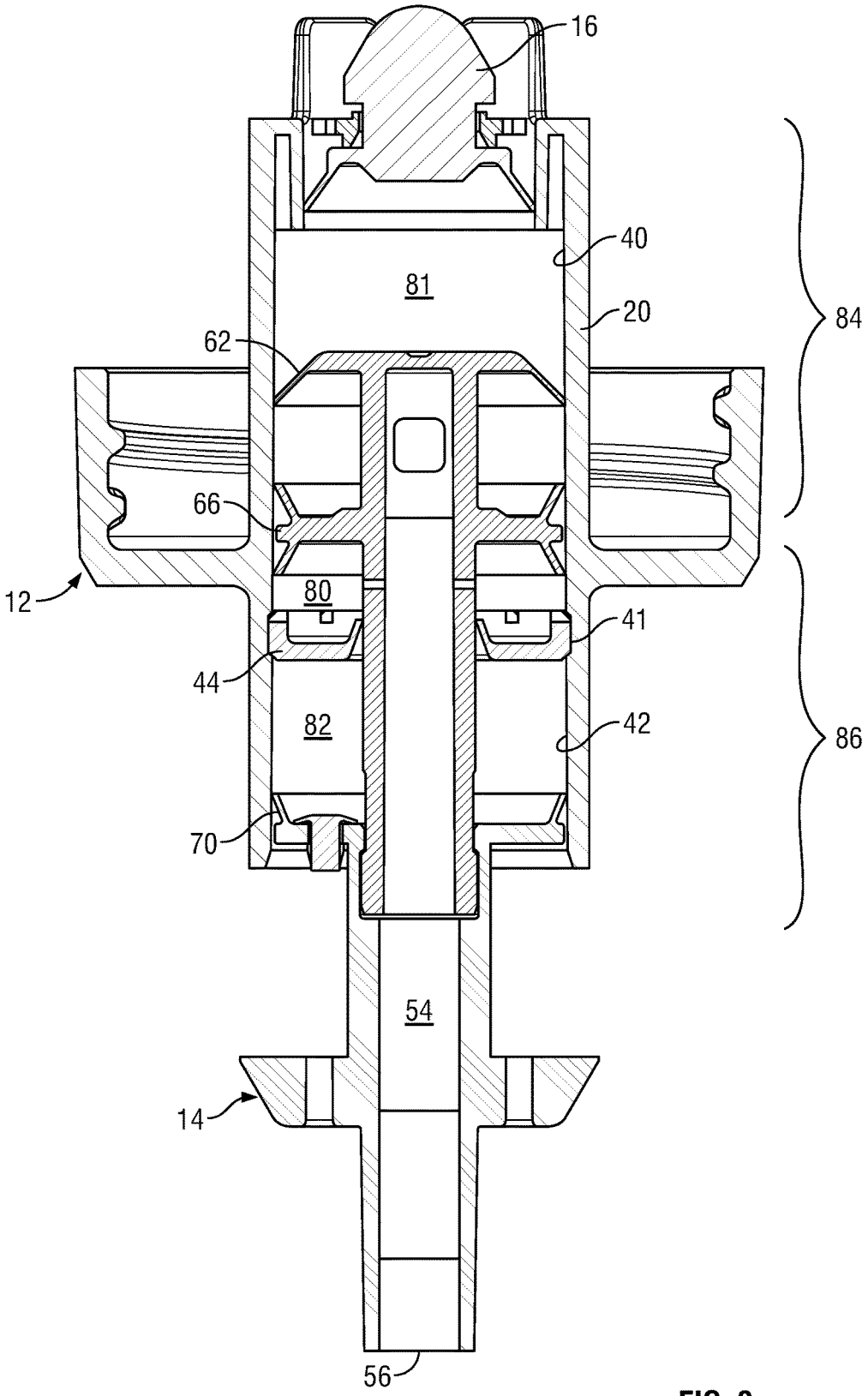
FIG. 3 is a cross-sectional front view of the pump of FIG. 1 the same as in FIG. 2 but in a withdrawn position.

Reference is made to FIGS. 1 to 3 which show a first embodiment of a piston pump 10 in accordance with the present invention. The piston pump 10 comprises a piston chamber-forming member or body 12, a piston-forming element or piston 14 and a one-way valve 16. Each of the body 12, the piston 14 and the one-way valve 16 is effectively coaxially disposed about a central axis 18. The body 12 has a generally cylindrical chamber wall 20 coaxially about the axis 18 defining a chamber 22 therein open at an outer open end 24. At an inner end 26, the chamber 22 is closed by an end flange 28, however, with openings 30 through the inner end placing the chamber 22 in communication with a liquid inside a liquid containing reservoir 102, only shown in FIG. 2. As seen in FIG. 2, an annular threaded collar 103 extends radially outwardly from the chamber wall 20 and presents radially inwardly directed threads for sealed engagement with a neck 101 of the reservoir 102. The one-way valve 16 is disposed across the openings 30 through the inner end 26 of the chamber 22 to prevent fluid flow axially inwardly past the one-way valve 16 into the reservoir 102 yet permit fluid flow outwardly past the one-way valve 16 into the chamber 22. As seen in FIG. 2, the end flange 28 has the openings 30 therethrough disposed in a circular array about the axis 18. A tubular member 31 extends radially inwardly into the chamber 22 presenting a radially inwardly directed cylindrical sealing tube wall 32. The end flange 28 has a center opening 29. The one-way valve 16 carries a valve member 33 which is secured in a friction-fit relation inside the central opening 31 and carries inwardly from the opening 31 a valve disc 34 that extends radially outwardly and axially outwardly to an annular distal end 35 in engagement with the tube wall 32 to prevent fluid flow axially inwardly therebetween. The annular distal end 35 of the valve disc 34 is resilient and has an inherent bias biasing the annular distal end 35 into engagement with the cylindrical tube wall 32 and deflectable against its bias from engagement with the cylindrical tube wall 32 to permit liquid flow axially outwardly therepast when a pressure differential between a pressure in the reservoir 102 is sufficiently greater than a pressure on the outer axial side of the valve disc 34.

The chamber wall 20 is shown as being stepped having an inner portion 40, an intermediate portion 41 and an outer portion 42. The inner portion 40 is of a smaller diameter than the outer portion 42. The intermediate portion 41 is of a smaller diameter than the outer portion 42 with the intermediate portion 41 effectively providing an annular groove intermediate the inner portion 40 and the outer portion 42. The body 12 carries an annular flange 44 received against axial movement within the annular groove formed by the intermediate portion 41 of the chamber wall 20. The annular flange 44 has an outer distal end 43 which sealably engages the chamber wall 20 to prevent fluid flow axially inwardly or outwardly therepast. The annular flange 44 extends radially inwardly from the outer distal end 43 to an annular disc 45 that extends axially inwardly and radially inwardly to an annular distal edge 46 providing a central opening through the annular flange 44 and adapted to engage a radially outwardly directed cylindrical wall 51 and a stem 50 of the piston 14. The annular distal edge 46 of the annular flange 44 engages the cylindrical wall 51 of the stem 50 to prevent fluid flow axially outwardly therebetween. The annular distal edge 46 of the annular flange 44 is resilient and has an inherent bias biasing the annular distal edge 46 into engagement with the cylindrical wall 51 of the stem 50. The annular distal edge 46 is deflectable against its bias from engagement with the cylindrical wall 51 of the stem 50 to permit air flow axially inwardly therebetween when a pressure differential between a pressure on outer axial side 47 of the annular flange 44 is sufficiently greater than a pressure on an inner axial side 48 of the annular flange 44.

The piston 14 includes the stem 50. The stem 50 is an elongate tubular member with a central passageway 54 longitudinally therethrough. The passageway 54 extends from a closed inner end 55 to an open end forming a discharge outlet 56. A first transfer port 64 extends radially inwardly through the stem 50 into the passageway 54. A second transfer port 68 extends radially inwardly through the stem 50 into the passageway 54. The first transfer port 64 and the second transfer port 68 are spaced axially from each other on the stem 50 with the second transfer port 68 spaced axially outwardly on the stem 50 from the first transfer port 64.

The stem 50 carries three discs: namely an inner liquid disc 62 at the inner end of the stem 50 axially inwardly of the first transfer port 64: a sealing disc 66 axially outwardly of the first transfer port 64 and axially inwardly of the second transfer port 68; and an outer disc 70 on the stem 50 axially outwardly of the second transfer port 68. The stem 50 also carries axially outwardly from the body 12 an annular engagement flange 72 useful for engagement of the piston 14 by an actuator member (not shown) as to move the piston 14 coaxially relative the body 12.

The inner liquid disc 62 extends radially outwardly from the stem 50 to an annular distal edge 65 in engagement with the inner portion 40 of the chamber wall 20 axially inwardly of the sealing disc 66. The annular distal edge 65 of the inner liquid disc 62 engages the chamber wall 20 to prevent fluid flow axially inwardly therebetween. The annular distal edge 65 of the inner liquid disc 62 is resilient and has an inherent bias biasing the annular distal edge 65 into engagement with the cylindrical chamber wall 20 and deflectable against the bias from engagement with the chamber wall 20 to permit liquid flow axially outwardly therebetween when a pressure differential between a pressure on an inner axial side of the inner liquid disc 62 is sufficiently greater than a pressure on an outer axial side of the inner liquid disc 62.

The sealing disc 66 extends radially outwardly from the stem 50 to annular distal edges 67 in engagement with the inner portion 40 of the chamber wall 20 axially inwardly of the annular flange 44. The annular distal edges 67 of the sealing disc 66 engage the chamber wall 20 to prevent fluid flow axially inwardly and axially outwardly therebetween.

The outer disc 70 extends radially outwardly from the stem 50 to an annular distal edge 71 in engagement with the outer portion 42 of the chamber wall 20 axially outwardly of the annular flange 44. The annular distal edge 71 of the outer disc 70 engages the chamber wall 20 to prevent fluid flow axially outwardly therebetween. The outer disc 70 carries a one-way valve mechanism 74 which permits air flow axially inwardly into the chamber 22 past the outer disc 70 when a pressure differential between an atmospheric pressure on an outer axial side of the outer disc 70 is sufficiently greater than a pressure on an inner axial side of the outer disc 70.

As can be seen in FIG. 2, the annular flange 44 of the body 12 is located about the stem 50 of the piston 14 in between the sealing disc 66 and the outer disc 70 on the stem 50.

The one-way valve mechanism 74 is formed by an axially extending opening 77 through the outer disc 70 and a resilient one-way valve member 78 disposed in the opening 77. The one-way valve member 78 has an inherent bias biasing the valve member 78 to close the opening 77 to flow axially outwardly therethrough and deflectable against its bias to permit air flow from the atmosphere axially inwardly when a pressure of the atmosphere is sufficiently greater than a pressure in the axial inside of the outer disc 70.

An annular inner air compartment 80 is defined radially between the stem 50 of the piston 14 and the chamber wall 20 of the body 12 axially between the sealing disc 66 on the piston 14 and the annular flange 44 on the body 12.

An annular outer air compartment 82 is defined radially between the stem 50 of the piston 14 and the chamber wall 20 of the body 12 axially between the annular flange 44 on the body 12 and the outer disc 70 on the piston 14.

The piston 14 is coaxially slidable within the body 12 between a withdrawn position as seen in FIG. 3 and a retracted position as seen in FIG. 2 in a cycle of operation comprising a withdrawal stroke and a retraction stroke. A withdrawal stroke is movement from the retracted position of FIG. 2 to the withdrawn position of FIG. 3. A retraction stroke is movement from the withdrawn position of FIG. 3 to the retracted position of FIG. 2. A liquid pump 84 is formed by the interaction of the inner portion 40 of the chamber wall 20, the chamber 22, the one-way valve 16 and an innermost portion of the piston 14 including the inner liquid disc 62, the first transfer port 64 and the sealing disc 66. A liquid compartment 81 is defined inside the chamber 22 axially in between the inner liquid disc 62 and the one-way valve 16.

In a withdrawal stroke on moving the piston 14 axially relative the body 12 from the retracted position of FIG. 2 to the withdrawn position of FIG. 3, the volume of the liquid compartment 81 increases drawing liquid from the reservoir 102 axially outwardly past the one-way valve 16. Thus, the withdrawal stroke comprises a charge stroke of the liquid pump 84 in which liquid is drawn from the reservoir into the liquid compartment 81 In a retraction stroke, on moving the piston 14 axially relative to the body 12 from the withdrawn position of FIG. 3 to the retracted position of FIG. 2, the volume of the liquid compartment 81 is reduced increasing the pressure within the liquid compartment 81 which closes the one-way valve 16 to flow axially inwardly therepast and deflects the inner liquid disc 62 to permit fluid flow axially outwardly therepast and then through the first transfer port 64 into the central passageway 54 and axially through the central passageway 54 to out the discharge outlet 56. The withdrawal stroke is a discharge stroke of the liquid pump 84 discharging liquid from the discharge outlet 56.

An air pump 86 is formed by the interaction of the body 12 including its chamber 22 and its annular flange 44 with the piston 14 including the sealing disc 66, the second transfer port 68 and the outer disc 70.

In a withdrawal stroke, on moving the piston 14 relative of the body 12 from the retracted position of FIG. 2 to the withdrawn position of FIG. 3, an axial distance between the annular flange 44 and the outer disc 70 increases thereby increasing a volume of the outer air compartment 82 and drawing air into the outer air compartment 82 via the one-way valve mechanism 74. In this withdrawal stroke, the axial distance between the sealing disc 66 and the annular flange 44 decreases thereby decreasing a volume of the inner air compartment 80 and discharging air from the inner air compartment 80 through the second transfer port 68 into the passageway 54 and through the passageway 54 to the discharge outlet 56 thereby displacing outwardly through the discharge outlet 56 of the passageway 54 any liquid within the passageway 54 outwardly from the second transfer port 68.

In a retraction stroke, on moving from the withdrawn position of FIG. 3 to the retracted position of FIG. 2, the axial distance between the annular flange 44 and the outer disc 70 decreases thereby decreasing the volume of the outer air compartment 82 and the axial distance between the sealing disc 66 and the annular flange 44 increases thereby increasing the volume of the inner air compartment 80, whereby air is transferred from the outer air compartment 82 to the inner air compartment 80 axially inwardly past the annular flange 44 between the annular flange 44 and the stem 50 by deflection of the inner distal edge 46 of the annular flange 44.

The liquid pump 84 and the air pump 86 operate such that in a first time interval comprising the retraction stroke, liquid is discharged from the liquid compartment 81 through the passageway 54 to the discharge outlet 56. At the end of the retraction stroke, the liquid is within the passageway 54 from the first transfer port 64 to the discharge outlet 56 filling the passageway 54. In a second time interval comprising the withdrawal stroke, the air pump 84 discharges air via the second transfer port 68 into the passageway 54 and out the discharge outlet 56 such that liquid within the passageway 54 between the second transfer port 68 and the discharge outlet 56 at the commencement of the withdrawal stroke is forced axially outwardly through the passageway 54 and out the discharge outlet 56.

The operation of the first embodiment has been described in a full stroke of operation in which the piston 14 is moved relative to the body 12 from a completely withdrawn position as shown in FIG. 3 to a completely retracted position as shown in FIG. 2. However, the pump will operate insofar as in any cycle of operation, the piston 14 is moved relative to the body 12 axially even if the extent of axial movement is less than between the fully extended position and the retracted position. Thus, even if a stroke of the pump is between a partially retracted condition and a partially withdrawn condition, the operation of the pump will be such that, in the retraction stroke, fluid is discharged by the liquid pump 84 into the passageway 54 and, in withdrawal stroke, the air is discharged by the air pump 86 air into the passageway 54 to displace liquid within the passageway 54.

In the first embodiment of FIGS. 1 to 3, to facilitate construction, the piston 14 is illustrated as being formed from two elements, namely, an inner piston portion 86 and an outer piston portion 87 which are fixedly secured together against axial movement and with the one-way valve mechanism 74 incorporating a separate valve body member 78. Rather than provide a one-way valve mechanism 74 as illustrated in the first embodiment utilizing the opening through the outer disc 70 and a separate valve body 78, the outer disc 70 may have its annular distal end 71 configured to be resilient and having an inherent bias biasing the annular distal end 71 into engagement with the chamber wall 20 and deflectable against this bias from engagement with the cylindrical wall 20 to permit air flow axially inwardly therepast when a pressure differential between a pressure on the outer axial side of the outer disc 70 is sufficiently greater than a pressure on an inner axial side of the outer disc 70.

In accordance with the first embodiment, during the retraction stroke, the liquid is forced through the first transfer port 64 into the passageway 54 to be discharged out the discharge outlet 56 and, in so doing, the liquid flow is axially past the second transfer port 68. The second transfer port 68 is chosen to have a relatively small cross-sectional area compared to the cross-sectional area for fluid flow through the first transfer port 64 and the cross-sectional area for fluid flow through the passageway 54. The resistance to liquid flow radially outwardly through the second transfer port 68 can substantially eliminate the propensity of liquid to flow radially outwardly through the second transfer port 68 into the inner air compartment 80. Moreover, with the outer portion 42 of the chamber wall 20 being of a greater diameter than the inner portion 40, in the retraction stroke, the pressure of air within the inner air compartment 80 is slightly increased above atmosphere during the retraction stroke as can be of assistance in resisting or preventing fluid flow radially outwardly from the passageway 54 through the second transfer port 68.

The relative viscosity and surface tensions of the liquid being dispensed will have an impact on the relative propensity of the liquid to flow radially outwardly through the second transfer port 68 as contrasted with axially past the second transfer port 68. Suitable selection of the relative sizing of the first transfer port 64, the second transfer port 68 and the passageway 54 may be determined by a person skilled in the art by simple experimentation towards selecting arrangements having regard to the liquid being dispensed to resist liquid flow through the second transfer port 68.

Figure 4:
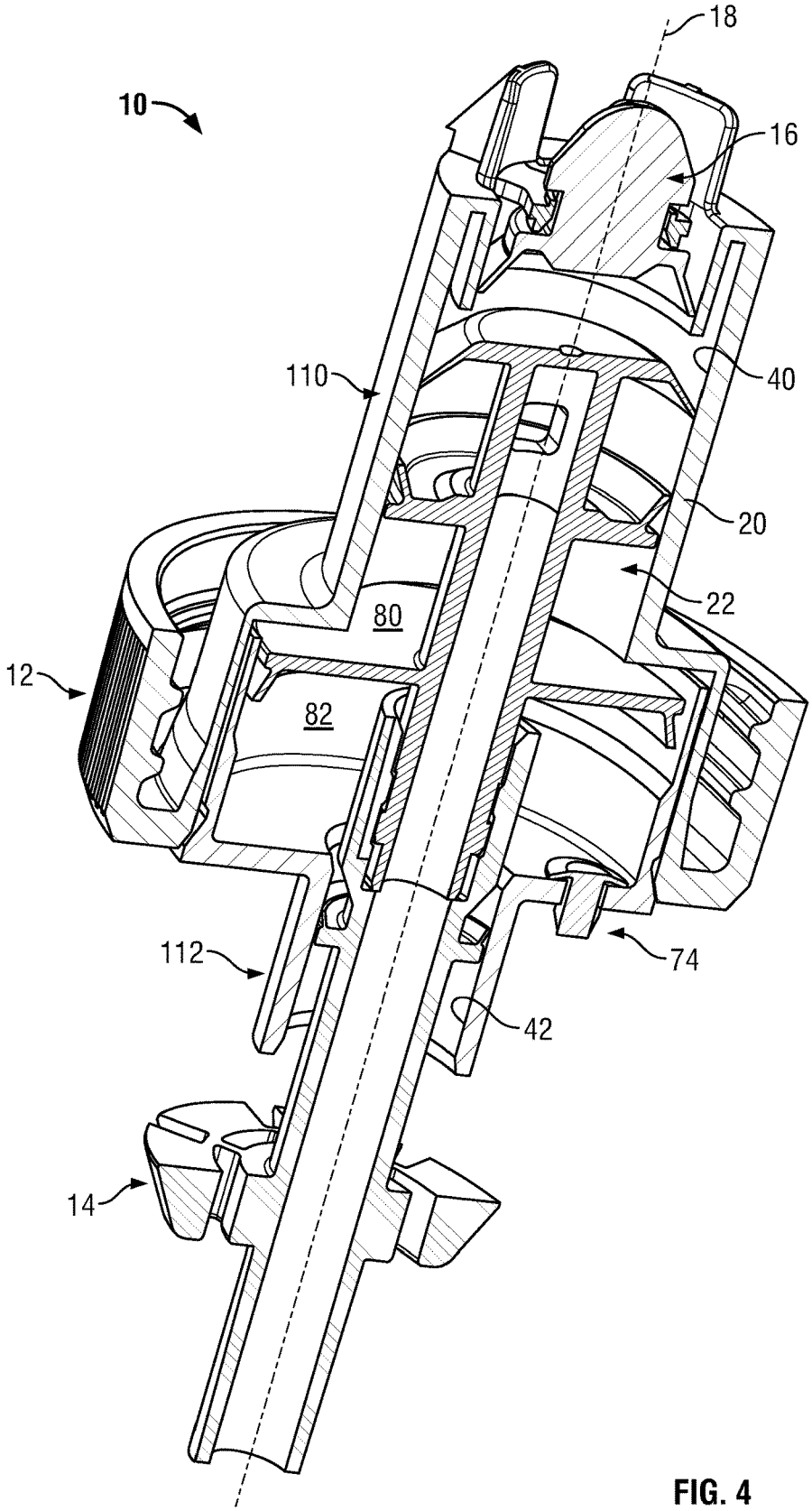
FIG. 4 is a pictorial cross-sectional front view of a piston pump in accordance with a second embodiment of the present invention with the piston in a retracted position during a retraction stroke.

Reference is made to FIGS. 4 to 12 which illustrate a second embodiment of a piston pump 10 in accordance with the present invention. In the figures, similar numerals are used to refer to similar elements. As can be seen in FIG. 4, the pump comprises a body 12, a piston 14 and a one-way valve 16 all disposed coaxially about an axis 18. The body 12 is formed from two elements, namely, an inner element 110 and an outer element 112 securely fixed together. In combination, the inner element 110 and the outer element 112 define a chamber 22 within a cylindrical chamber wall 20. The chamber wall 20 has three major portions, namely, an inner portion 40, and intermediate portion 41 and an outer portion 42. The diameter of the inner portion 40 is greater than the diameter of the outer portion 42. The intermediate portion 41 has diameters less than the diameters of the outer portion 42. The intermediate portion 41 has two axial segments, namely, an inner axial segment 121 and an outer axial segment 123 with the outer axial segment being of a diameter greater than the inner axial segment 121 and with the inner axial segment 121 and the outer axial segment 123 joined by a bevelled shoulder 122.

The piston 14 of the second embodiment of FIG. 4 has some features similar to the piston of the first embodiment of FIG. 1. The chamber 20 has an inner end including a one-way valve 16 substantially identical to that described in the first embodiment of FIG. 1. Similarly, the piston 14 carries at its inner end, the inner liquid disc 62, the first transfer port 64 and the sealing disc 66 for engagement with the inner portion 40 of the chamber wall 20 to form a liquid pump 84 which operates identically to that illustrated and described with reference to the first embodiment of FIG. 1.

As seen in FIG. 4, the piston 14 carries an outer disc 70 which is coaxially slidable within the outer portion 42 of the chamber wall 20 on the body 12 and provides a similar interaction to that in the first embodiment. However, the outer disc 70 in FIG. 4 does not carry the one-way valve mechanism 74. Rather, in the embodiment of FIG. 4, a one-way valve mechanism 74 is provided through an annular shoulder 175 of the outer portion 112 of the body 12. The one-way valve mechanism 74 comprises an axial opening 77 through the shoulder 175 within which the valve body member 78 is received to permit air flow axially inwardly but prevent air flow axially outwardly.

On the stem 50 of the piston 14, an inner air disc 90 is provided axially in between the sealing disc 66 and the outer disc 70. A second transfer port 68 is provided on the stem 50 axially in between the outer disc 70 and the inner air disc 90. In the second embodiment of FIG. 4, the piston 14 is formed from two elements, namely, an inner piston portion 201 and an outer piston portion 202.

Figure 5:
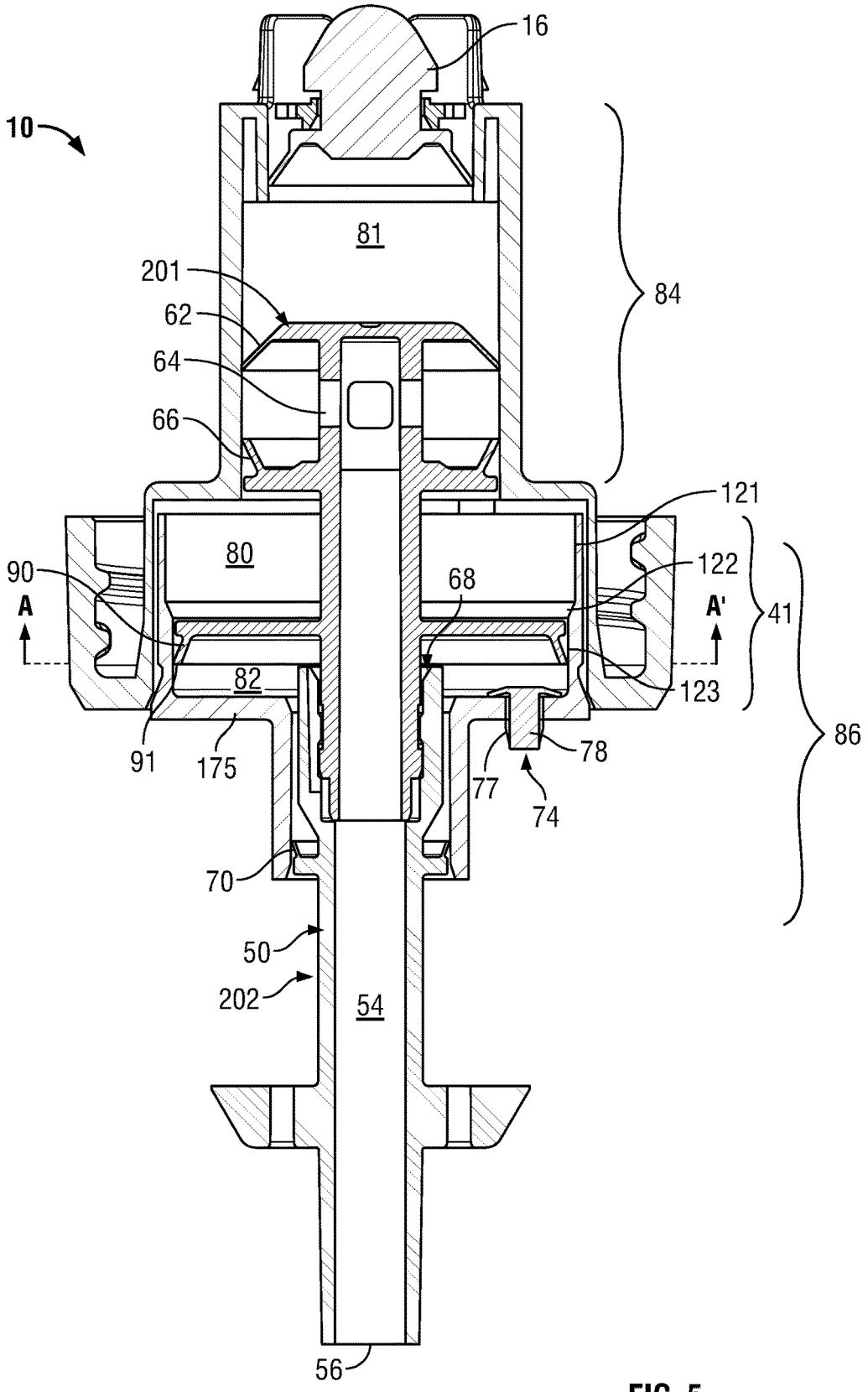
FIG. 5 is a cross-sectional front view of the pump of FIG. 4 showing the piston in the retraction stroke in a withdrawn position.
Figure 11:
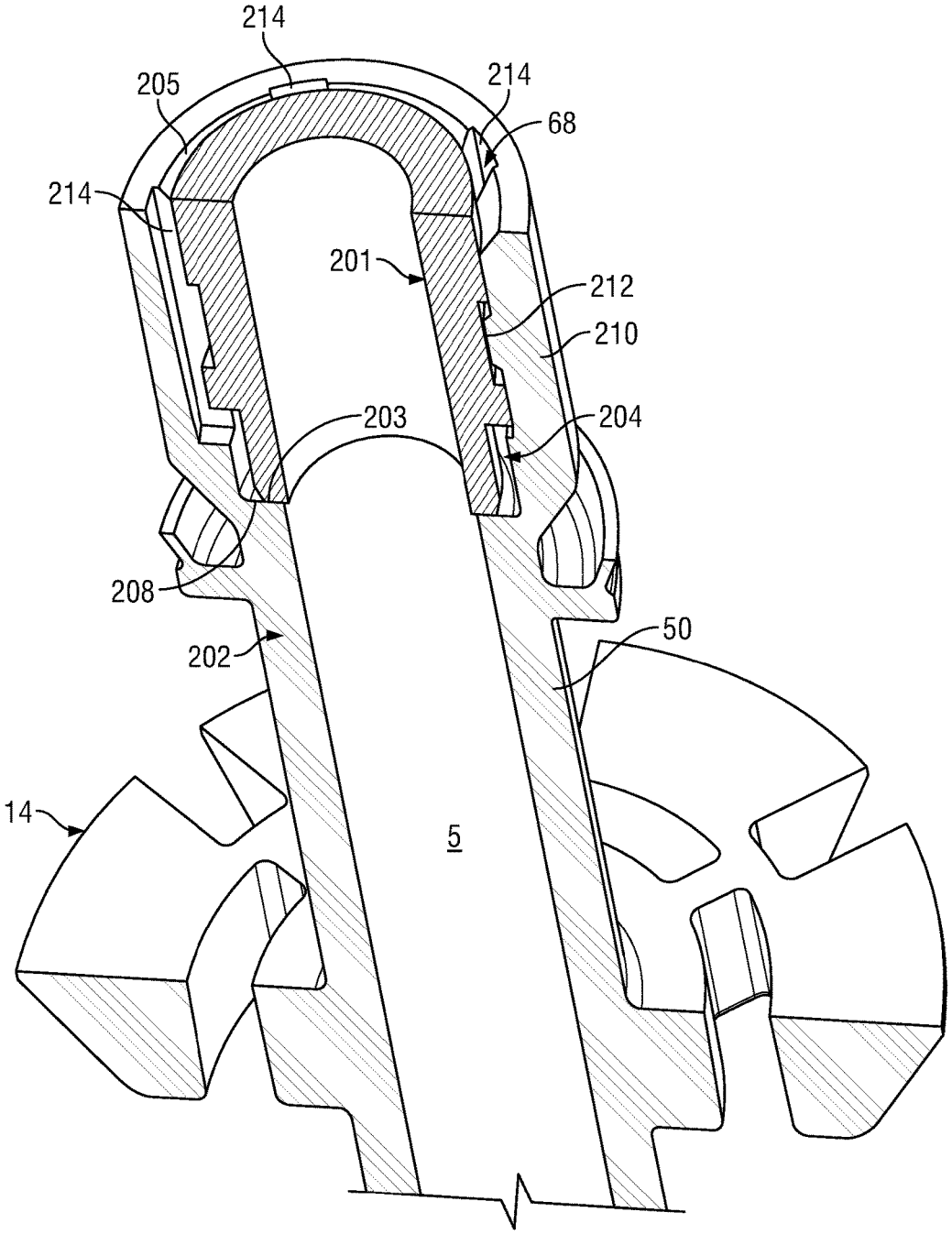
FIG. 11 is a pictorial cross-sectioned front view of the piston of FIG. 4 during a retraction stroke with the piston also cross-sectioned normal to its longitudinal axis along section line A-A' in FIG. 6.
Figure 12:
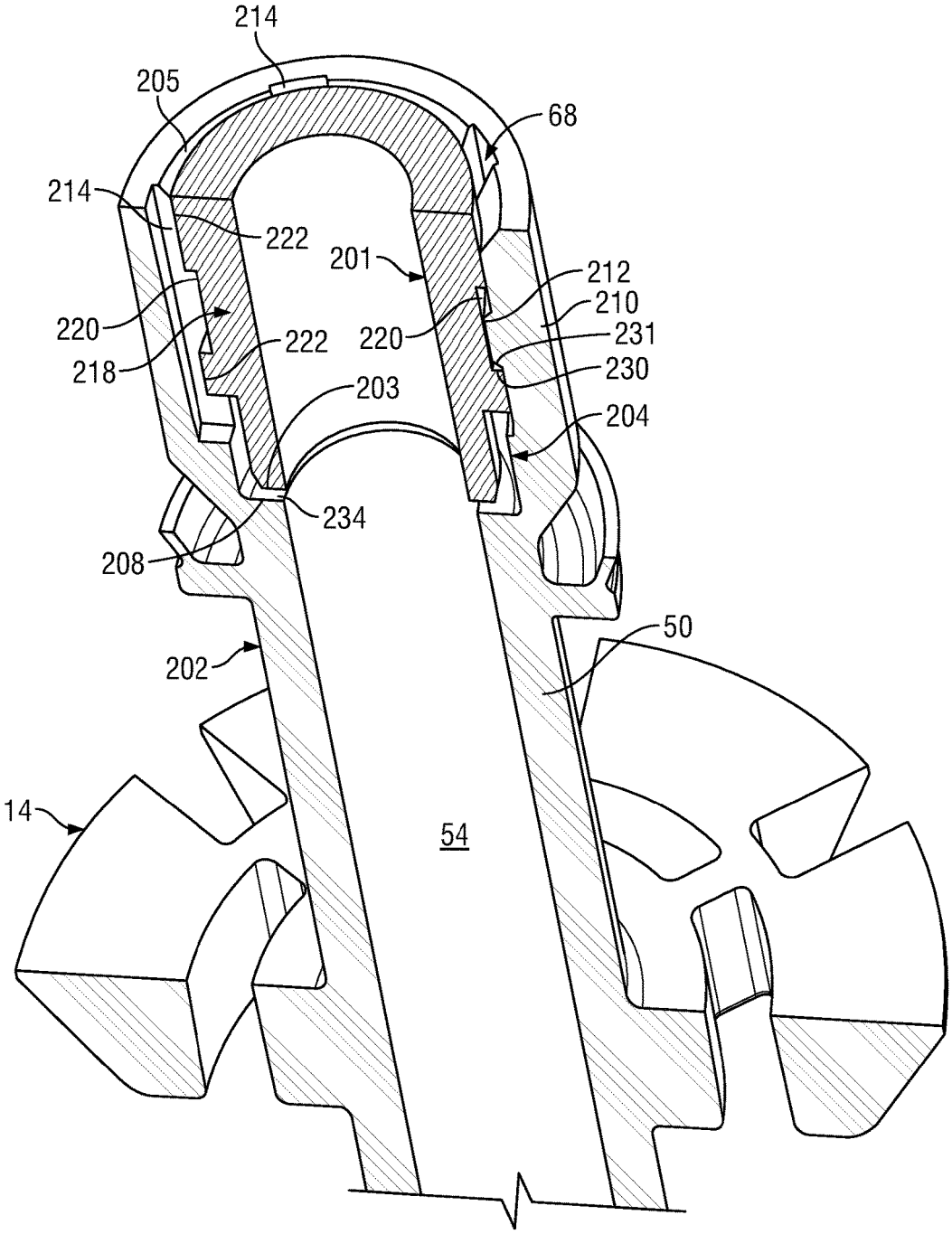
FIG. 12 is a cross-sectioned pictorial view the same as FIG. 11, however, during a withdrawal stroke.

FIGS. 11 and 12 are each pictorial views of merely the piston 14, however, cross-sectioned along section line A-A' in FIG. 5 and showing that the inner piston portion 201 and the outer piston portion 202 are coaxially slidable relative each other between a compressed condition as shown in FIG. 11 and an expanded condition as shown in FIG. 12. In the extended condition as seen in FIG. 12, the second transfer port 68 is provided radially through the stem 50 into the passageway 54. However, in the compressed condition as shown in FIG. 11, the second transfer port 68 is closed. The piston 14 assumes the extended position of FIG. 12 when the outer portion 202 is drawn axially outwardly relative to the inner portion 201 in a withdrawal stroke. The piston 14 assumes the compressed condition of FIG. 11 when the outer piston portion 202 is urged axially into the inner piston portion 201 in the retraction stroke. Thus, the coaxial sliding of the inner piston portion 201 and the outer piston portion 202 provides a valving arrangement which closes the second transfer port 68 during a retraction stroke and opens the second transfer port 68 during the withdrawal stroke.

The outer piston portion 202 carries at its axial inner end 203, an axially inwardly opening socket 204 open at an inner end 205. The socket 204 is provides at an outer end an axially inwardly directed annular seating surface 208. The socket 204 has a cylindrical radially inwardly directed socket side wall 210 carrying a radially inwardly extending annular rib 212. At circumferentially locations about the socket side wall 210 axially extending channelways 214 are cut from the cylindrical socket side wall 210 extending axially downwardly from the inner end 205 of the socket 204 to the seating surface 208.

The axial outer end of the inner piston portion 201 comprises a tubular member 218 with a radially outwardly directed surface 222 ending at its outer end an axially outwardly directed seat surface 203. The tubular member 218 has a circumferential annular groove 220 extending radially inwardly from its radially outwardly directed surface 222. The tubular member 218 at the outer end of the inner piston portion 201 is coaxially engaged within the socket 204 of the outer piston portion 202 with the annular rib 212 of the outer portion 202 received within the annular groove 220 of the inner piston portion 201. The annular rib 212 has an axial extent less than the axial extent of annular groove 220. When the inner piston portion 201 and outer piston portion 202 are engaged with each other, the axially outwardly directed seat surface 203 of the inner piston portion 201 is opposed to the axially inwardly directed seating surface 208 of the outer piston portion 202. The axial extent of the rib 212 is less than the axial extent of the groove 220 permitting relative axial sliding between (a) the compressed condition as shown in FIG. 11 in which the seat surface 203 of the inner piston portion 201 sealably engages the seating surface 208 of the outer piston portion 202 to prevent fluid flow therebetween to the channelways 214 and (b) the extended position in which an axially inwardly directed shoulder 230 on the rib 212 engages an axially outwardly directed shoulder 231 of the groove 220 to stop relative axial sliding in the position of FIG. 12 with the seat surface 203 separated axially from the seating surface 208 providing an axially and radially extending gap 234 providing a radial flow path for flow of fluid radially through the stem 50 of the piston 14 via the channelways 214 and gap 234 between the seat surface 203 and the seating surface 208 into the passageway 54. In FIG. 12 channelways 214 and gap 234 provide the second transfer port 68 through the stem 50 to the passageway. As illustrated in FIGS. 11 and 12, the inner piston portion 201 and the outer piston portion 202 provide a loss link arrangement for opening and permitting flow through the second transfer port 68 in a withdrawal stroke and for closing and preventing flow through the second transfer port 68 in a retraction stroke.

Referring to FIG. 5, an inner air compartment 80 is defined radially between the stem 50 of the piston and the chamber wall 20 of the body 12 and axially between the sealing disc 66 and the inner air disc 90. An outer air compartment 82 is defined radially between the stem 50 of the piston 14 and the chamber wall 20 of the body 12 axially between the inner air disc 90 and the outer disc 70.

The second embodiment of FIG. 4 includes a fluid pump 84 that operates in substantially the same manner as the fluid pump 84 of the first embodiment of FIG. 1. In a retraction stroke, liquid is discharged from a liquid compartment 81 via the first transfer port 64 into the passageway 54 and out the discharge outlet 56. In a withdrawal stroke, liquid is drawn from the reservoir into the liquid compartment 81.

Figure 6:
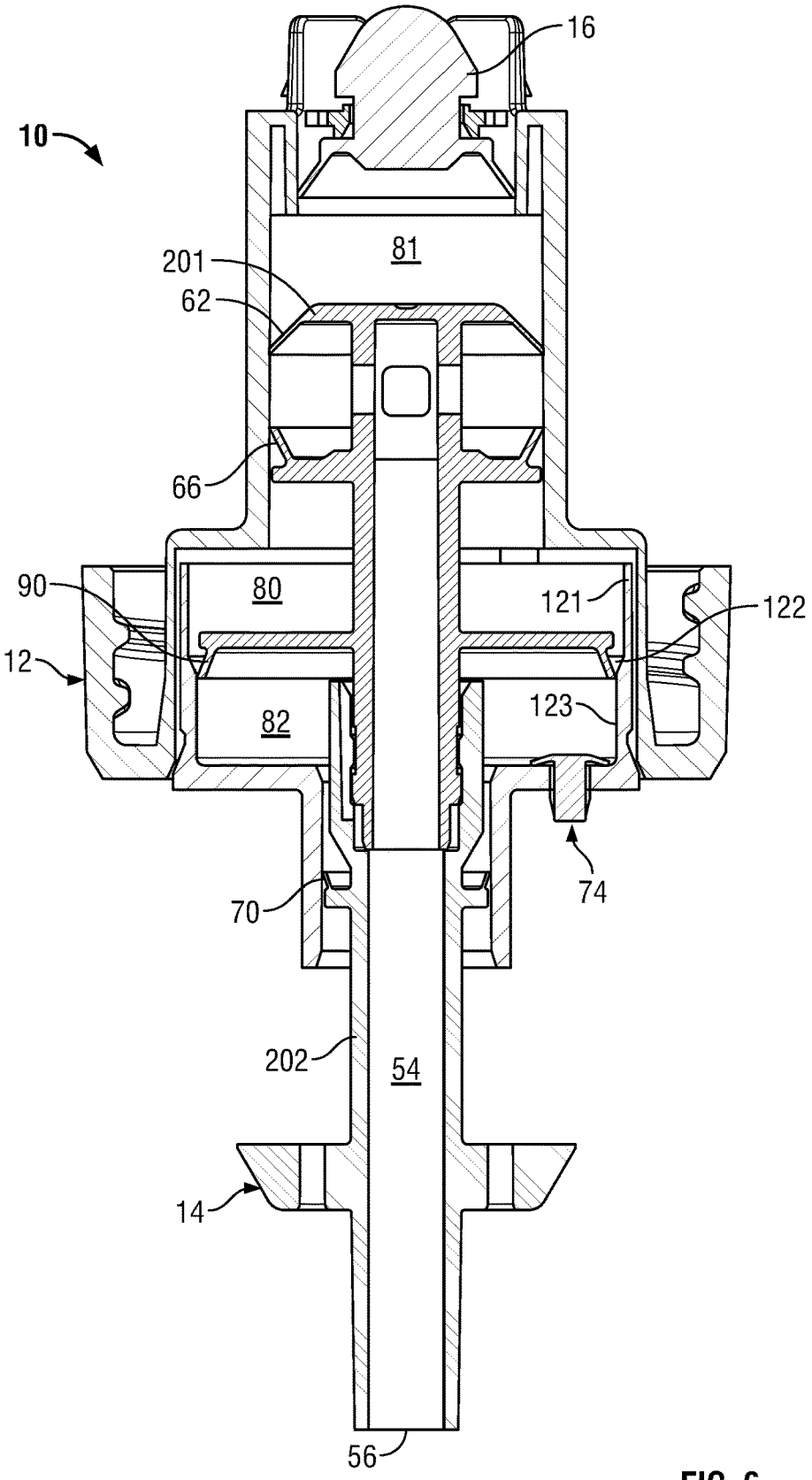
FIG. 6 is a cross-sectional front view of the same of FIG. 5 but showing the piston in the retraction stroke in an intermediate position.
Figure 7:
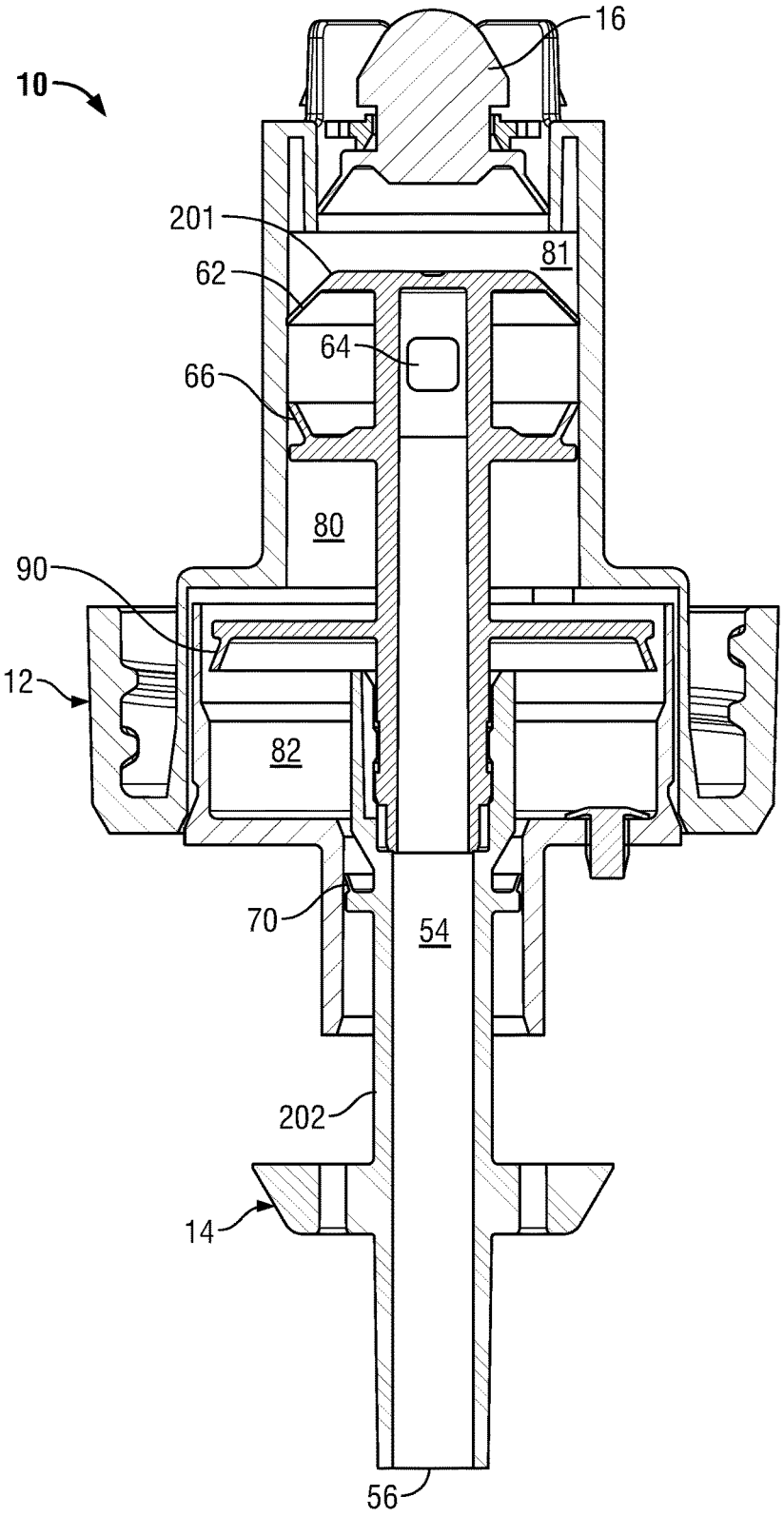
FIG. 7 is a cross-sectional front view the same as FIG. 5 but showing the piston in the retraction stroke in the retracted position.
Figure 8:
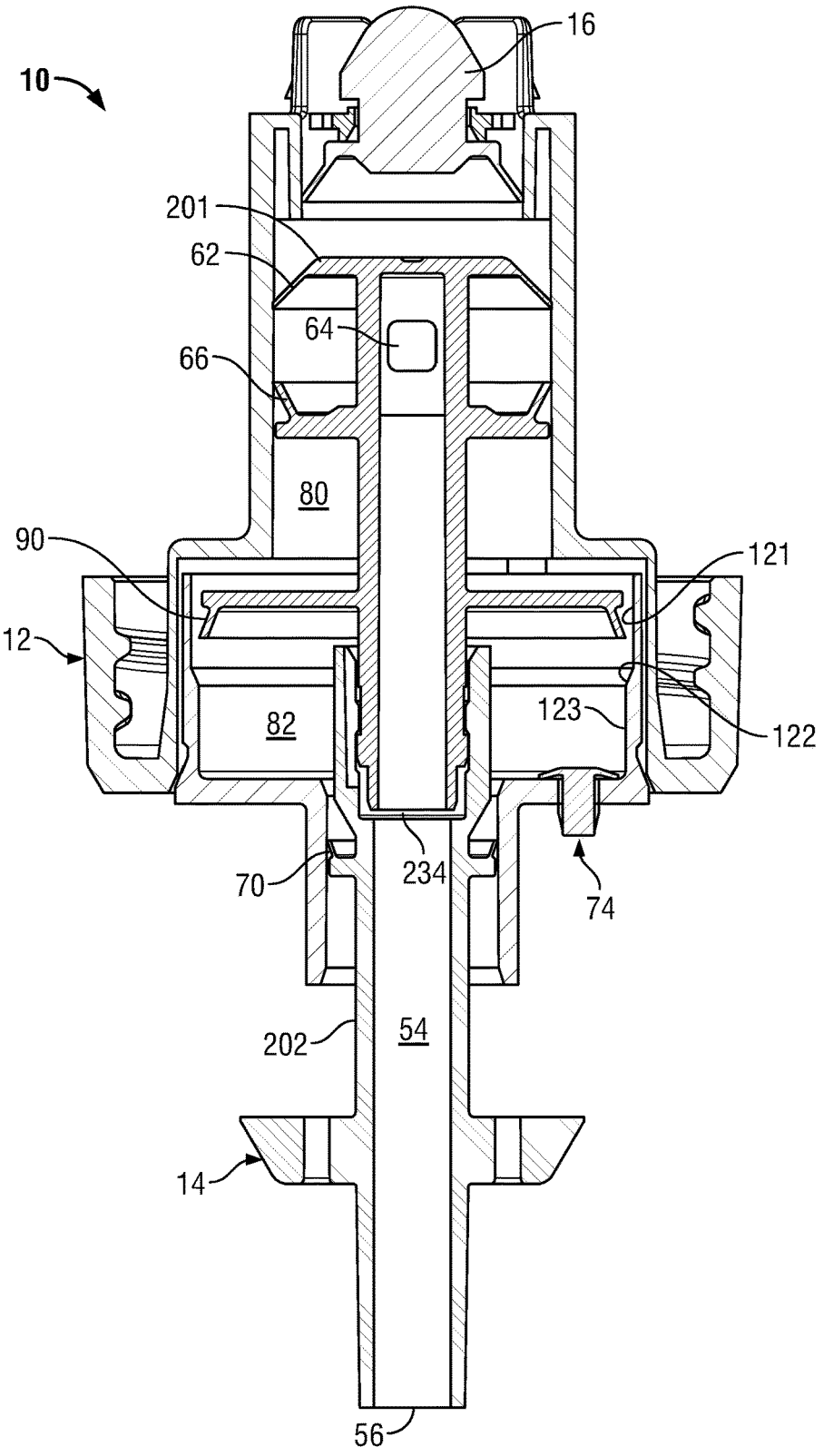
FIG. 8 is a cross-sectional front view the same as FIG. 7 but showing the piston in a withdrawal stroke in the retracted position.
Figure 9:
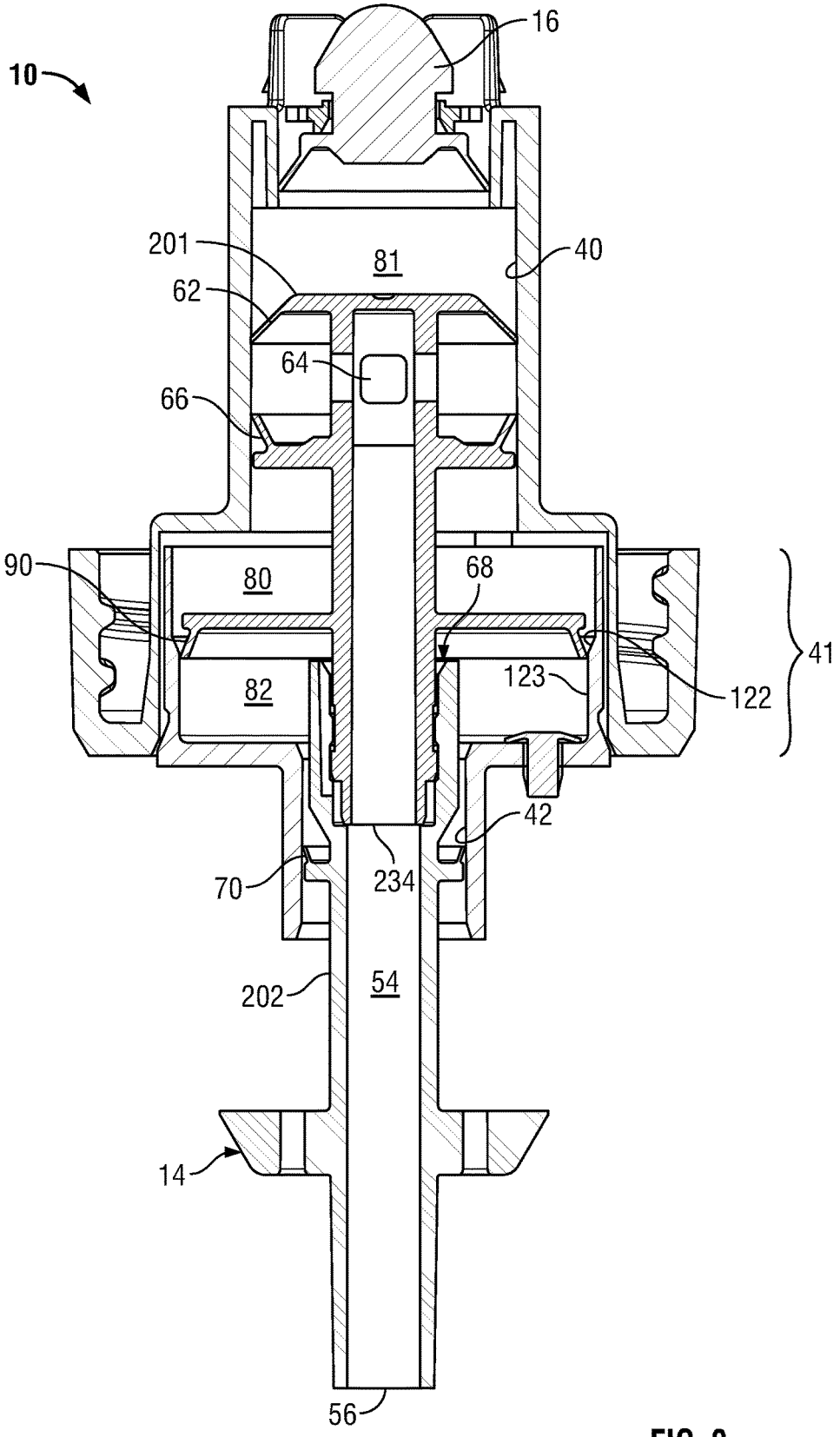
FIG. 9 is a cross-sectional view the same as FIG. 8 but showing the piston in a withdrawal stroke in the intermediate position.
Figure 10:
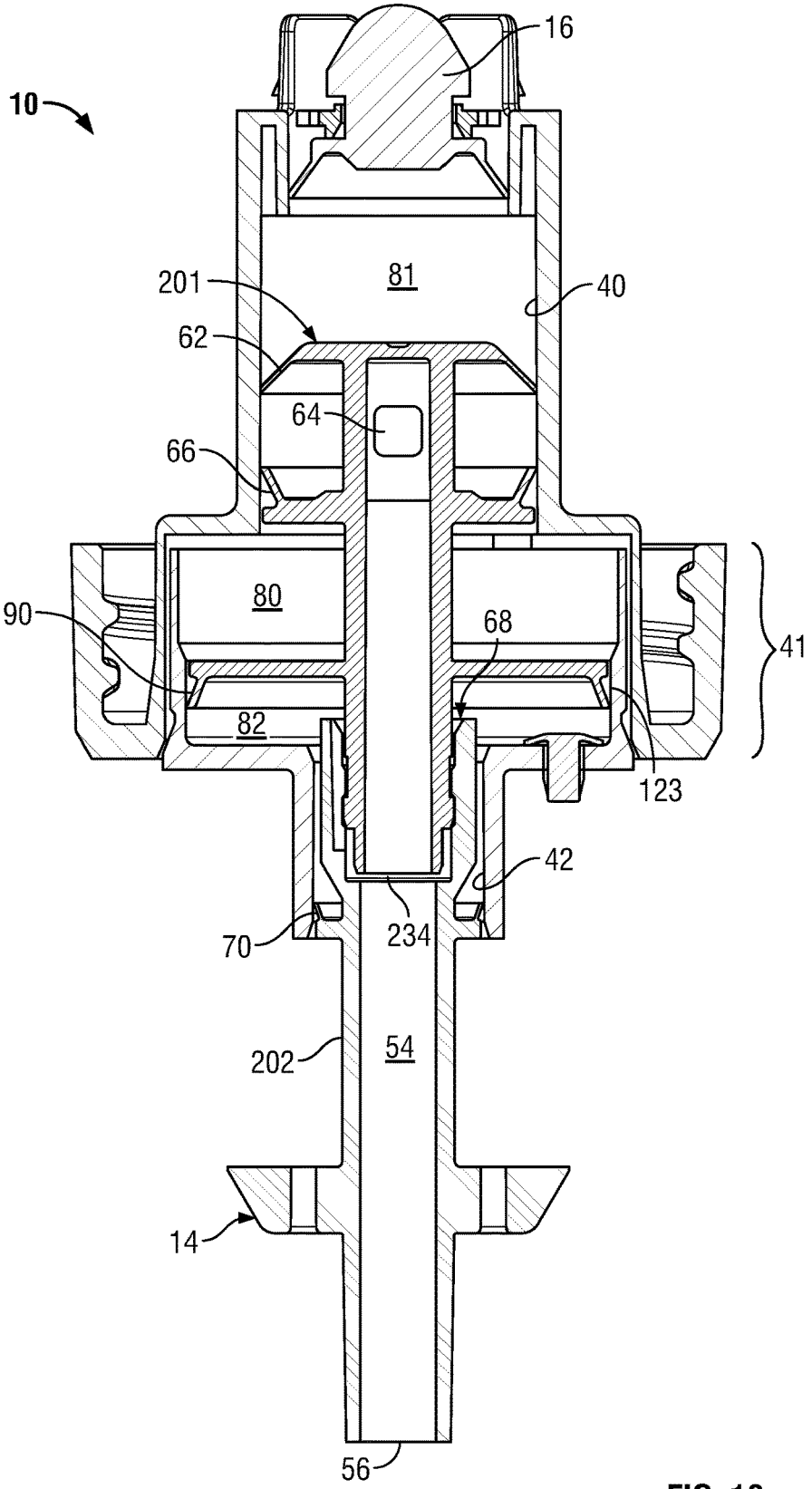
FIG. 10 is a cross-sectional front view the same as FIG. 9 but showing the piston in a withdrawal stroke in the withdrawn position.

The second embodiment of FIG. 4 also has an air pump 86 formed between the first interacting elements of the body 12 and piston 14 as will now be described with reference to a cycle of operation represented by, in sequence, FIGS. 5 to 10 representing a single cycle of operation in which FIGS. 5, 6 and 7 represent a retraction stroke from a withdrawn position of FIG. 5 to an intermediate position of FIG. 6 to a retracted position and then in FIGS. 8, 9 and 10 in a withdrawal stroke from a retracted position of FIG. 8 to an intermediate position of FIG. 9 to a withdrawn position of FIG. 10.

In the retraction stroke as shown in FIGS. 5, 6 and 7, the outer piston portion 202 is urged axially inwardly into the inner piston portion 201 assuming the compressed condition as shown in FIG. 11 in which the second transfer port 68 is closed. In contrast, in the withdrawal stroke as shown in FIGS. 8, 9 and 10, the outer piston portion 202 is drawn axially away from the inner piston portion 201 assuming an extended condition as shown in FIG. 12 and the second transfer port 68 is open.

The inner air disc 90 has an annular distal edge 91 having a diameter smaller than the diameter of the inner segment 121 of the intermediate portion 41 of the chamber wall 20. While the inner air disc 90 is within the inner segment 121 of the intermediate portion 41, air may freely flow axially inwardly and axially outwardly between the inner air disc 90 and the intermediate chamber portion 41 and thus between the inner air compartment 80 above the inner air disc 90 and the outer air compartment 82 below the inner disc 90. The inner air disc 90 has a diameter such that its annular distal edge 91 engages the outer segment 123 of the intermediate wall portion 41 of the chamber wall 20 to prevent liquid flow axially inwardly therepast while the inner air disc 90 is within the outer segment 123 of the intermediate wall portion 41.

In a retraction stroke, in movement from the withdrawn position of FIG. 5 to the intermediate position of FIG. 6, the inner air disc 90 is within the outer segment 123 and the volume of the outer air compartment 82 increases since the diameter of the inner air disc 90 is greater than the diameter of the outer disc 70. As a result, air is drawn inwardly through the one-way valve mechanism 74 from the atmosphere into the outer air compartment 82. In a retraction stroke, on movement inward from the intermediate position of FIG. 6, the inner air disc 90 enters the inner segment 121 with the inner air disc 90 coming out of engagement of the chamber wall 20 and air flow being permitted in between the outer air compartment 82 and the inner air compartment 80 with movement to the fully retracted position.

During the retraction stroke in moving from the position of FIG. 5 to the position of FIG. 7, the fluid pump 84 is discharges liquid from the liquid compartment 81 out the first transfer port 64 into the passageway 54 to the discharge outlet 56. Liquid passes axially past the second transfer port 68 since the second transfer port 68 is in a closed position as in FIG. 11 preventing liquid flowing from the passageway 54 through the second transfer port 68 into the outer air compartment 82.

In a withdrawal stroke, in moving from the position of FIG. 8 through the position of FIG. 9 to the position of FIG. 10, the outer piston portion 202 and the inner piston portion 201 are in the extended position and the second transfer port 68 is open as seen in FIG. 12. In moving from the retracted position of FIG. 8 through the intermediate position of FIG. 9 to the withdrawn position of FIG. 10, the liquid pump 84 draws liquid from the reservoir past the one-way valve 16 into the liquid compartment 81. In a withdrawal stroke, in moving from the retracted position of FIG. 8 to the intermediate position of FIG. 9, since the inner air disc 90 is within the inner segment 121, the air is free to pass axially between the inner air compartment 80 and the outer air compartment 82. The combined volume of the inner air compartment 80 and the outer air compartment 82 stays the same during a cycle of operation or may increase or preferably decrease to a minor amount in each cycle of operation. In a withdrawal stroke, on reaching the intermediate position of FIG. 9, the inner air disc 90 engages the outer segment 123 of the chamber wall 20. With movement from the intermediate position of FIG. 9 to the withdrawn position of FIG. 10, the volume of the outer air compartment 82 decreases, pressure is increased in the outer air compartment 82 closing the one-way valve mechanism 74 and air within the outer air compartment 82 is forced under pressure through the open second transfer port 68 into the passageway 54 and axially out through the passageway 54 to the discharge outlet 56 thereby displacing fluid within the passageway 54 outwardly of the second transfer port 68. Preferably, a sufficient volume of air is discharged so as to force from and clear the passageway 54 outwardly of the second transfer port 68 of all liquid.

In accordance with the present invention, the fluid pump is being shown as a positive displacement pump with a separate one-way valve 16. A separate one-way valve 16 could be avoided by providing the fluid pump as within a stepped portion of the chamber as, for example, with an inner liquid disc to have a smaller diameter to be received in a smaller diameter portion of the chamber 22 than the sealing disc 66.

While the invention has been described with reference to preferred embodiments, many modifications and variations will now occur to persons skilled in the art. For a definition of the invention, reference is made to the following claims.

We claim:

1. A piston pump comprising:

a piston chamber-forming member extending longitudinally about an axis from an inner end to an outer end;

the piston chamber-forming member defining a central chamber therein coaxially about the axis within an annular chamber wall;

the piston chamber-forming member having a liquid inlet at the inner end in communication with a liquid in a reservoir;

a piston-forming element coaxially slidably received within the chamber in the piston chamber-forming member;

the piston-forming element comprising an elongate tubular stem with a central passageway longitudinally therethrough, the passageway extending from an inner end to an outer end;

the piston-forming element coaxially slidable within the piston chamber-forming member between a withdrawn position and a retracted position in a cycle of operation comprising a withdrawal stroke and a retraction stroke to draw the liquid from the reservoir via the liquid inlet and discharge the liquid through the outer end of the passageway;

a first transfer port extending radially inwardly through the stem into the passageway, a second transfer port which extends radially inwardly through the stem into the passageway spaced axially outwardly on the stem from the first transfer port, a liquid pump formed between the piston chamber-forming member and the piston-forming element proximate the inner end of the piston chamber-forming member, the liquid pump operative in the cycle of operation in the withdrawal stroke, to draw the liquid from the reservoir via the liquid inlet and, in the retraction stroke, to discharge the liquid through the first transfer port into the passageway and through the passageway to the outer end of the passageway and outwardly through the outer end of the passageway;

an air pump formed between the piston chamber-forming member and the piston-forming element operative in the cycle of operation in the retraction stroke to draw air from the atmosphere and, in the withdrawal stroke, to discharge air into the passageway through the second transfer port into the passageway and through the passageway to the outer end of the passageway thereby displacing outwardly through the outer end of the passageway any fluid within the passageway outwardly from the second transfer port, an annular sealing flange on the piston chamber-forming member, the sealing annular flange extending from the chamber wall radially inwardly to an annular distal edge in engagement with a radially outwardly directed cylindrical wall on the stem axially outwardly the second transfer port;

the annular distal edge of the annular sealing flange engaging the cylindrical wall of the stem to prevent fluid flow axially outwardly therepast, the annular distal edge of the annular sealing flange being resilient and having an inherent bias biasing the annular distal edge into engagement with the cylindrical wall of the stem and deflectable against the bias from engagement with the cylindrical wall of the stem to permit air flow axially inwardly therepast when a pressure differential between a pressure on an outer axial side of the annular sealing flange is sufficiently greater than a pressure on an inner axial side of the annular sealing flange;

a sealing disc on the stem axially inwardly of the second transfer port and axially outwardly of the first transfer port, the sealing disc carried on the stem axially inwardly of the sealing annular flange on the piston chamber-forming member;

the sealing disc extending radially outwardly from the stem to an annular distal edge in engagement with the chamber wall on the piston chamber-forming member axially inwardly of the annular sealing flange;

the annular distal edge of the sealing disc engaging the chamber wall on the piston chamber-forming member to prevent fluid flow axially inwardly and axially outwardly therepast;

an outer disc on the stem axially outwardly of the sealing disc, the outer disc extending radially outwardly from the stem to an annular distal edge in engagement with the chamber wall on the piston chamber-forming member axially outwardly of the annular sealing flange;

the annular distal edge of the outer disc engaging the chamber wall on the piston chamber-forming member to prevent fluid flow axially outwardly therebetween;

a one-way valve mechanism permitting air flow axially inwardly into the chamber between the annular sealing flange and the outer disc when a pressure in the chamber between the annular sealing flange and the outer disc axial side of the outer disc is sufficiently less and a pressure of the atmosphere;

the air pump having an inner air compartment defined (a) annularly between the stem of the piston-forming element and the chamber wall of the piston chamber-forming member, and (b) axially between the sealing disc and the sealing annular flange;

the air pump having an outer air compartment defined (a) annularly between the stem of the piston-forming element and the chamber wall of the piston chamber-forming member, and (b) axially between the sealing annular flange and the outer disc;

in a cycle of operation:

(a) in the withdrawal stroke, (i) an axial distance between the sealing annular flange and the outer disc increases thereby increasing a volume of the outer air compartment and drawing air into the outer air compartment via the one-way valve mechanism, and (ii) an axial distance between the sealing disc and the sealing annular flange decreases thereby decreasing a volume of the inner air compartment and discharging air from the inner air compartment through the second transfer port into the passageway and through the passageway to the outer end of the passageway thereby displacing outwardly through the outer end of the passageway the fluid within the passageway outwardly from the second transfer port, and (b) in the retraction stroke, (iii) the axial distance between the sealing annular flange and the outer disc decreases thereby decreasing the volume of the outer air compartment, and (iv) the axial distance between the sealing disc and the sealing annular flange increases thereby increasing the volume of the inner air compartment, whereby air is transferred from the outer air compartment to the inner air compartment axially inwardly between the sealing annular flange and the stem.

2. A pump as claimed in claim 1 wherein in the withdrawal stroke the air discharged into the passageway through the second transfer port by the air pump is sufficient to replace all fluid within the passageway between the second transfer port and the outer end of the passageway with air.

3. A pump as claimed in claim 1 wherein the outer disc carries the one-way valve mechanism permitting air flow axially inwardly into the chamber past the outer disc when a pressure differential between a pressure on an outer axial side of the outer disc is sufficiently greater than a pressure on an inner axial side of the outer disc.

4. A pump as claimed in claim 1 wherein the one-way valve mechanism is formed by an opening through the outer disc between the outer air compartment and the atmosphere and a resilient one-way valve member disposed in the opening and having an inherent bias biasing the valve member to close the opening to flow therethrough and deflectable against the bias to permit air flow from the atmosphere into the outer air compartment when a pressure of the atmosphere is sufficiently greater than a pressure in the outer air compartment.

5. A pump as claimed in claim 1 wherein the one-way valve mechanism formed by the annular distal edge of the outer disc being resilient and having an inherent bias biasing the annular distal edge into engagement with the cylindrical wall of the stem and deflectable against the bias from engagement with the cylindrical wall of the stem to permit air flow axially inwardly therepast when a pressure differential between a pressure on an outer axial side of the outer disc is sufficiently greater than a pressure on an inner axial side of the outer disc.

6. A pump as claimed in claim 1 including:

an inner liquid disc on the stem axially inwardly of the first transfer port, the inner liquid disc extending radially outwardly from the stem to an annular distal edge in engagement with the chamber wall on the piston chamber-forming member axially inwardly of the sealing disc;

the annular distal edge of the inner liquid disc engaging the chamber wall on the piston chamber-forming member to prevent fluid flow axially inwardly therepast;

the annular distal edge of the inner liquid disc being resilient and having an inherent bias biasing the annular distal edge into engagement with the cylindrical wall of the stem and deflectable against the bias from engagement with the cylindrical wall of the stem to permit liquid flow axially outwardly therepast when a pressure differential between a pressure on an inner axial side of the inner liquid disc is sufficiently greater than a pressure on an outer axial side of the inner liquid disc;

a liquid compartment defined (a) annularly between the stem of the piston-forming element and the chamber wall of the piston chamber-forming member, and (b) axially between the inner liquid disc and the sealing disc;

wherein in a cycle of operation, in the retraction stroke, the liquid is discharged from the liquid compartment through the first transfer port into the passageway.

7. A piston pump comprising:

a piston chamber-forming member extending longitudinally about an axis from an inner end to an outer end;

the piston chamber-forming member defining a central chamber therein coaxially about the axis within an annular chamber wall;

the piston chamber-forming member having a liquid inlet at the inner end in communication with a liquid in a reservoir;

a piston-forming element coaxially slidably received within the chamber in the piston chamber-forming member;

the piston-forming element comprising an elongate tubular stem with a central passageway longitudinally therethrough, the passageway extending from an inner end to an outer end;

the piston-forming element coaxially slidable within the piston chamber-forming member between a withdrawn position and a retracted position in a cycle of operation comprising a withdrawal stroke and a retraction stroke to draw the liquid from the reservoir via the liquid inlet and discharge the liquid through the outer end of the passageway;

a first transfer port extending radially inwardly through the stem into the passageway, a second transfer port which extends radially inwardly through the stem into the passageway spaced axially outwardly on the stem from the first transfer port, a liquid pump formed between the piston chamber-forming member and the piston-forming element proximate the inner end of the piston chamber-forming member, the liquid pump operative in the cycle of operation in the withdrawal stroke to draw the liquid from the reservoir via the liquid inlet and, in the retraction stroke, to discharge the liquid through the first transfer port into the passageway and through the passageway to the outer end of the passageway and outwardly through the outer end of the passageway;

an air pump formed between the piston chamber-forming member and the piston-forming element operative in the cycle of operation in the retraction stroke to draw air from the atmosphere and, in the withdrawal stroke, to discharge air into the passageway through the second transfer port into the passageway and through the passageway to the outer end of the passageway thereby displacing outwardly through the outer end of the passageway any fluid within the passageway outwardly from the second transfer port, an inner air disc on the stem axially inwardly of the second transfer port, the inner air disc extending radially outwardly from the stem to an annular distal edge in engagement with an inner cylindrical portion of the chamber wall on the piston chamber-forming member;

the annular distal edge of the inner air disc engaging the inner cylindrical portion of chamber wall on the piston chamber-forming member to prevent fluid flow axially inwardly therepast at least during a terminal portion of the retraction stroke;

an outer disc on the stem axially outwardly of the inner air disc and axially outwardly of the second transfer port, the outer disc extending radially outwardly from the stem to an annular distal edge in engagement with an outer cylindrical portion of the chamber wall on the piston chamber-forming member;

the outer cylindrical portion of the chamber wall having a diameter less than a diameter of the inner cylindrical portion of the chamber wall;

the annular distal edge of the outer disc engaging the outer cylindrical portion of chamber wall on the piston chamber-forming member to prevent fluid flow axially outwardly therebetween, a one-way air valve permitting atmosphere air flow axially inwardly into the chamber to between the inner air disc and the outer disc axially outwardly of the inner air disc when a pressure differential between a pressure on an outer axial side of the outer disc is sufficiently greater than a pressure on an inner axial side of the outer disc, the air pump having an outer air compartment defined (a) annularly between the stem of the piston-forming element and the chamber wall of the piston chamber-forming member, and (b) axially between the inner air disc and the outer disc;

in a cycle of operation:

(a) in the retraction stroke, a volume of the outer air compartment increases drawing air into the air compartment via the one-way air valve, and (b) in the withdrawal stroke, the volume of the outer air compartment decreases discharging air from the outer air compartment through the second transfer port into the passageway and through the passageway to the outer end of the passageway thereby displacing outwardly through the outer end of the passageway the fluid within the passageway outwardly from the second transfer port.

8. A pump as claimed in claim 7 including a valving arrangement which closes the second transfer port to flow therethrough during the retraction stroke.

9. A pump as claimed in claim 7 wherein in the charge stroke the air discharged into the passageway through the second transfer port by the air pump is sufficient to replace all fluid within the passageway between the second transfer port and the outer end of the passageway with air.

10. A pump as claimed in claim 7 wherein the air pump is operative in the cycle of operation during merely a terminal portion of the retraction stroke to draw air from the atmosphere and merely, in an initial portion of the withdrawal stroke, to discharge air into the passageway through the second transfer port into the passageway and through the passageway to the outer end of the passageway thereby displacing outwardly through the outer end of the passageway the fluid within the passageway outwardly from the second transfer port.

11. A pump as claimed in claim 7 including:

the liquid pump including a sealing disc on the stem axially inwardly of the inner air disc and axially outwardly of the first transfer port, the sealing seal disc extending radially outwardly from the stem to an annular distal edge in engagement with the chamber wall on the piston chamber-forming member axially inwardly of the inner air disc;

the annular distal edge of the sealing disc engaging the chamber wall on the piston chamber-forming member to prevent fluid flow axially inwardly and axially outwardly therebetween;

an inner liquid disc on the stem axially inwardly of the first transfer port, the inner liquid disc extending radially outwardly from the stem to an annular distal edge in engagement with the chamber wall on the piston chamber-forming member axially inwardly of the sealing disc;

the annular distal edge of the inner liquid disc engaging the chamber wall on the piston chamber-forming member to prevent fluid flow axially inwardly therepast;

the annular distal edge of the inner liquid disc being resilient and having an inherent bias biasing the annular distal edge into engagement with the chamber wall and deflectable against the bias from engagement with the chamber wall to permit liquid flow axially outwardly therepast when a pressure differential between a pressure on an inner axial side of the inner liquid disc is sufficiently greater than a pressure on an outer axial side of the inner liquid disc;

a one-way valve across the liquid inlet permitting the liquid to flow from the reservoir to the chamber and preventing the liquid to flow from the chamber to the reservoir, a liquid compartment defined in the chamber axially between the one-way valve and the inner liquid disc wherein in a cycle of operation, in the retraction stroke, the liquid is discharged from the liquid compartment axially outwardly past the inner liquid disc and through the first transfer port into the passageway.

12. A pump as claimed in claim 7 wherein the one-way air valve is formed by an opening through the piston chamber-forming member between an outer end of the outer air compartment and the atmosphere and a resilient one-way valve member disposed in the opening and having an inherent bias biasing the valve member to close the opening to flow therethrough and deflectable against the bias to permit air flow from the atmosphere into the outer air compartment when a pressure of the atmosphere is sufficiently greater than a pressure in the outer air compartment.

13. A pump as claimed in claim 7 wherein the one-way air valve is formed by the annular distal edge of the outer disc being resilient and having an inherent bias biasing the annular distal edge into engagement with the chamber wall and deflectable against the bias from engagement with the chamber wall to permit air flow axially inwardly therepast when a pressure differential between a pressure on an outer axial side of the outer disc is sufficiently greater than a pressure on an inner axial side of the outer disc.

14. A pump as claimed in claim 7 wherein:

during a terminal portion of the retraction stroke and an initial portion of the withdrawal stroke, the annular distal edge of the inner air disc is within the outer cylindrical portion with the annular distal edge of the inner air disc engaging the outer cylindrical portion of chamber wall on the piston chamber-forming member to prevent fluid flow axially inwardly therepast;

while the annular distal edge of the inner air disc is within the inner cylindrical portion of chamber wall on the piston chamber-forming member, fluid flow is provided axially between the annular distal edge of the inner air disc and the inner cylindrical portion of chamber wall on the piston chamber-forming member.

15. A pump as claimed in claim 7 wherein:

the fluid pump including a sealing disc on the stem axially inwardly of the inner air disc and axially outwardly of the first transfer port, the sealing seal disc extending radially outwardly from the stem to an annular distal edge in engagement with the chamber wall on the piston chamber-forming member axially inwardly of the inner air disc;

the annular distal edge of the sealing disc engaging the chamber wall on the piston chamber-forming member to prevent fluid flow axially inwardly and axially outwardly therebetween.

16. A pump as claimed in claim 15 wherein an inner air compartment defined (a) annularly between the stem of the piston-forming element and the chamber wall of the piston chamber-forming member, and (b) axially between the sealing disc and the inner air disc;

while the annular distal edge of the inner air disc is within the inner cylindrical portion of the chamber wall on the piston chamber-forming member, fluid flow is provided between the inner air compartment and the outer air compartment axially between the annular distal edge of the inner air disc and the inner cylindrical portion of the chamber wall on the piston chamber-forming member.

17. A pump as claimed in claim 15 including:

an inner liquid disc on the stem axially inwardly of the first transfer port, the inner liquid disc extending radially outwardly from the stem to an annular distal edge in engagement with the chamber wall on the piston chamber-forming member axially inwardly of the sealing disc;

the annular distal edge of the inner liquid disc engaging the chamber wall on the piston chamber-forming member to prevent fluid flow axially inwardly therepast;

the annular distal edge of the inner liquid disc being resilient and having an inherent bias biasing the annular distal edge into engagement with the chamber wall and deflectable against the bias from engagement with the chamber wall to permit liquid flow axially outwardly therepast when a pressure differential between a pressure on an inner axial side of the inner liquid disc is sufficiently greater than a pressure on an outer axial side of the inner liquid disc;

a one-way valve across the liquid inlet permitting the liquid to flow from the reservoir to the chamber and preventing the liquid to flow from the chamber to the reservoir, a liquid compartment defined in the chamber axially between the one-way valve and the inner liquid disc;

wherein in a cycle of operation, in the retraction stroke, the liquid is discharged from the liquid compartment axially past the inner liquid disc and through the first transfer port into the passageway.

18. A pump as claimed in claim 12 wherein:

the liquid pump including a sealing disc on the stem axially inwardly of the inner air disc and axially outwardly of the first transfer port, the sealing seal disc extending radially outwardly from the stem to an annular distal edge in engagement with the chamber wall on the piston chamber-forming member axially inwardly of the inner air disc;

the annular distal edge of the sealing disc engaging the chamber wall on the piston chamber-forming member to prevent fluid flow axially inwardly and axially outwardly therebetween.

19. A pump as claimed in claim 18 wherein an inner air compartment is defined (a) annularly between the stem of the piston-forming element and the chamber wall of the piston chamber-forming member, and (b) axially between the sealing disc and the inner air disc;

while the annular distal edge of the inner air disc is within the inner cylindrical portion of chamber wall on the piston chamber-forming member, fluid flow is provided between the inner air compartment and the outer air compartment axially between the annular distal edge of the inner air disc and the inner cylindrical portion of chamber wall on the piston chamber-forming member.

20. A pump as claimed in claim 19 including:

an inner liquid disc on the stem axially inwardly of the first transfer port, the inner liquid disc extending radially outwardly from the stem to an annular distal edge in engagement with the chamber wall on the piston chamber-forming member axially inwardly of the sealing disc;

the annular distal edge of the inner liquid disc engaging the chamber wall on the piston chamber-forming member to prevent fluid flow axially inwardly therepast;

the annular distal edge of the inner liquid disc being resilient and having an inherent bias biasing the annular distal edge into engagement with the chamber wall and deflectable against the bias from engagement with the chamber wall to permit liquid flow axially outwardly therepast when a pressure differential between a pressure on an inner axial side of the inner liquid disc is sufficiently greater than a pressure on an outer axial side of the inner liquid disc;

a one-way valve across the liquid inlet permitting the liquid to flow from the reservoir to the chamber and preventing the liquid to flow from the chamber to the reservoir, a liquid compartment defined axially between one-way valve and the inner liquid disc;

wherein in a cycle of operation, in the retraction stroke, the liquid is discharged from the liquid compartment axially past the inner liquid disc and through the first transfer port into the passageway.

* * * * *